US005218375A

United States Patent [19]

Hillman

[11] Patent Number: 5,218,375

[45] Date of Patent: Jun. 8, 1993

[54] RAPIDLY EXTENDIBLE AND RETRACTABLE ANTENNA MAST

[75] Inventor: Darrel D. Hillman, Weatherford, Tex.

[73] Assignee: Antenna Products Corporation, Mineral Wells, Tex.

[21] Appl. No.: 792,970

[22] Filed: Nov. 15, 1991

[51] Int. Cl.[5] ..... H01Q 1/10

[52] U.S. Cl. ..... 343/883; 343/903; 52/118

[58] Field of Search ..... 343/883, 901, 903; 521/118, 121

[56] References Cited

U.S. PATENT DOCUMENTS

| | | | |
|---|---|---|---|
| 2,233,222 | 2/1941 | Patan | 343/903 |
| 2,698,873 | 1/1955 | Allsworth et al. | 343/883 |
| 3,495,370 | 2/1970 | Habro et al. | 52/118 |
| 3,959,795 | 5/1976 | Foster | 343/883 |
| 4,151,534 | 4/1979 | Bond | 343/883 |
| 4,176,360 | 11/1979 | Leavy et al. | 343/883 |
| 4,212,015 | 7/1980 | Graf et al. | 343/883 |
| 4,254,423 | 3/1981 | Reinhard | 343/883 |
| 4,785,309 | 11/1988 | Gremillion | 343/883 |
| 4,932,176 | 6/1990 | Roberts et al. | 343/883 |
| 5,035,094 | 7/1991 | Legare | 343/903 |
| 5,052,645 | 10/1991 | Hixon | 343/883 |
| 5,101,215 | 3/1992 | Creaser, Jr. | 343/883 |

*Primary Examiner*—Michael C. Wimer
*Assistant Examiner*—Tan Ho
*Attorney, Agent, or Firm*—Charles D. Gunter, Jr.

[57] ABSTRACT

An extendible and retractable mast is shown which features a tubular body having telescopic sections carried therein. A travelling carriage is driven by means of a winch over associated sheaves to sequentially engage the trailing ends of the telescopic sections for moving the sections between a collapsed position and any desired degree of elevation projecting from the upper end of the tubular body. A series of locking cams allow each telescopic section to be locked into position at a desired degree of elevation. A power assist is provided for assisting the retraction of the telescopic sections.

11 Claims, 8 Drawing Sheets

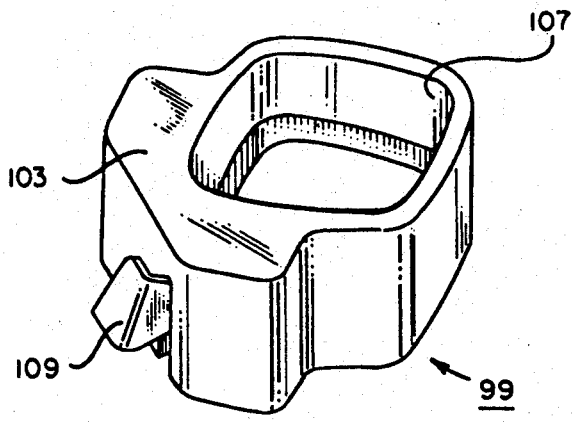
FIG. 7
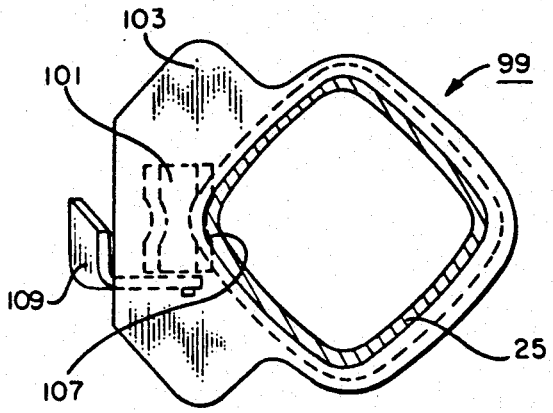
FIG. 8
FIG. 9
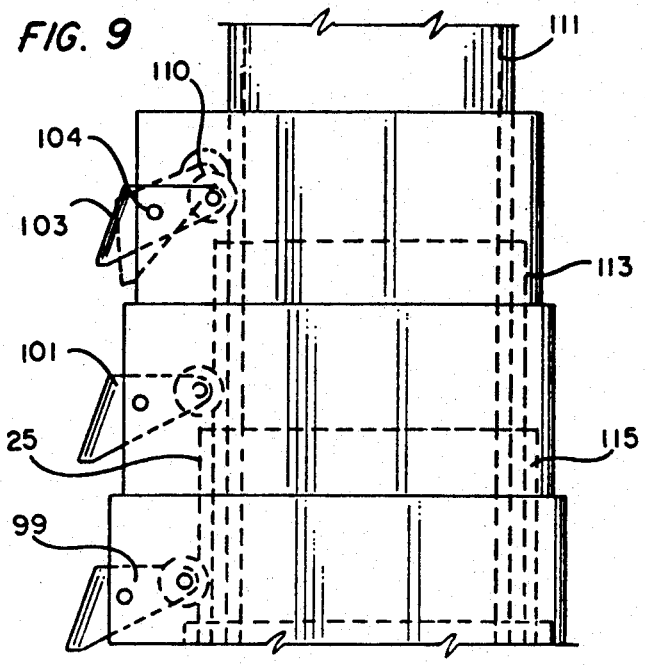
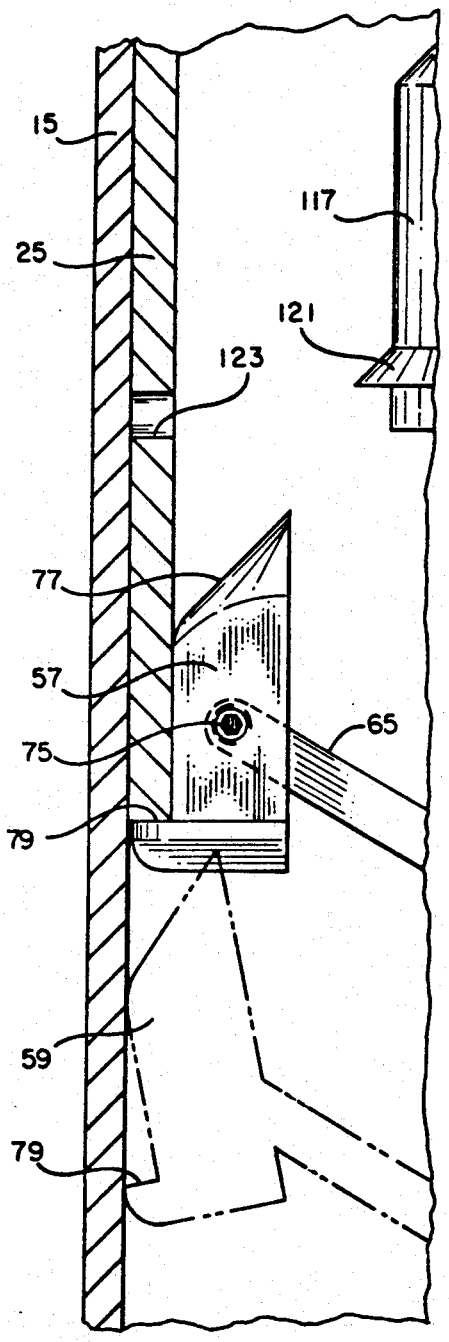
FIG. 10

RAPIDLY EXTENDIBLE AND RETRACTABLE ANTENNA MAST

BACKGROUND OF THE INVENTION

1. Field of the Invention

The present invention relates generally to telescoping members of the type used to support antennas and other appliances required to be elevated above the surrounding terrain. The invention is more specifically directed to a rapidly extendible and retractable antenna mast and a method of forming the same.

2. Description of the Prior Art

A variety of prior art devices are known for vertically extending and retracting masts of the type used for supporting antennae or other appliances required to be supported above the surrounding terrain. The prior art devices include antenna deploying systems utilizing telescopic sections as well as cable and pulley systems for mechanical assistance. Other of the prior art systems did not utilize mechanical assistance in raising the telescopic sections. Pneumatic and hydraulic systems have also been utilized to provide a power assist in raising and lowering the telescopic sections of the devices.

The prior art devices have tended to be overly complicated and expensive to manufacture. U.S. Pat. Nos. 4,151,534; and 4,176,360 are typical of the prior art systems. These systems utilize a plurality of cables and pulleys or mechanisms in which the cable snakes in and out of the respective sections of telescopic tubing. In addition to the complexity of such devices, as much as 300 to 400 feet of cable and 4 or more pulleys for each section were required to erect a 30 foot antenna.

Especially in the case of military applications, it is desirable to provide a rapidly extendible and retractable mast which is portable in nature, allowing it to be carried by an individual. It is also desirable to provide such a mast featuring a mechanical assist to extend and retract the telescopic sections thereof, allowing the mast to be erected to a 30 foot height in about 1 minute or less.

A need also exists for such an extendible mast which would be operatable by means of a continuous length of cable and fewer parts and pulleys than were required in the prior art devices.

A need also exists for such a device which includes a power retract mechanism for retracting the telescopic sections in order to move the device to a new location.

SUMMARY OF THE INVENTION

The rapidly extendible and retractable antenna mast of the invention includes a portable, tubular body having an upper end, a lower end and an open interior with a central, longitudinal axis. A plurality of tubular, telescopic sections of consecutively reduced transverse dimension are carried within the portable tubular body. Each of the telescopic sections has a leading end and a trailing end. A travelling carriage is centrally located within the portable, tubular body for travel along the central, longitudinal axis of the portable, tubular body. Engagement means, located on the travelling carriage, sequentially engage the trailing ends of the telescopic sections for erecting the sections from the portable body between collapsed positions substantially wholly engaged within the portable body to erected positions of virtually any desired degree of elevation projecting from the upper end of the portable body. Drive means are provided for moving the travelling carriage along the central, longitudinal axis of the portable body between an extended position and a retracted position. Preferably, the drive means is operatively connected to the travelling carriage by a continuous length of cable.

In the preferred embodiment, the travelling carriage is an elongated body having an upper end, a lower end and a longitudinal axis. The loop of cable is attached to the upper and lower ends, respectively, of the carriage, thereby forming a continuous loop. The engagement means comprises a plurality of spring biased engagement dogs carried on the travelling carriage. The dogs are normally biased outwardly in a radial direction with respect to the longitudinal axis of the elongate body. A plurality of locking cams are carried on the portable, tubular body. Each locking cam is associated with a selected one of the tubular, telescopic sections of consecutively reduced transverse dimension for locking the selected telescopic section at any desired degree of elevation projecting from the upper end of the portable body.

A retraction means, located on the travelling carriage, is provided for assisting in retracting the telescopic sections from the elevated, projecting position to the collapsed position. The retraction means preferably comprises a second, distinct set of spring biased, retraction dogs carried on the travelling carriage and arranged oppositely to the engagement dogs.

A selector means, provided as a part of the portable body, allows the alternate actuation of the engagement dogs and the retraction dogs to selectively erect and retract the telescopic sections as the travelling carriage moves up and down the central, longitudinal axis. Preferably, the selector means includes a selector sleeve having a lower cam surface formed thereon for contacting the engagement dogs. The cam sleeve is shiftable between a lifting position in which the engagement dogs are spring biased radially outward and a lowering position in which the engagement dogs are biased radially inward. The selector sleeve also has an upper cam surface for contacting the retraction dogs, wherein movement of the cam sleeve from the lifting position to the lowering position causes the retraction dogs to move from a first, radially inward biased position to a second, radially outward biased position. A hand operated lever is provided for shifting the selector sleeve between the lifting and lowering positions.

Additional objects, features and advantages will be apparent in the written description which follows.

BRIEF DESCRIPTION OF THE DRAWINGS

FIG. 7 is an isolated, top view of one of the locking cams used to lock a telescopic section of the mast at a desired degree of elevation;

FIG. 8 is a bottom view of the locking cam of FIG. 7 showing the operative components thereof in dotted lines;

FIG. 9 is a schematic view of the upper end of the mast of FIG. 1 showing the operation of the locking cams thereof;

FIG. 10 is a partial, sectional view of one of the telescopic sections of the mast being raised within the portable, tubular body;

DETAILED DESCRIPTION OF THE INVENTION

Figure 1:
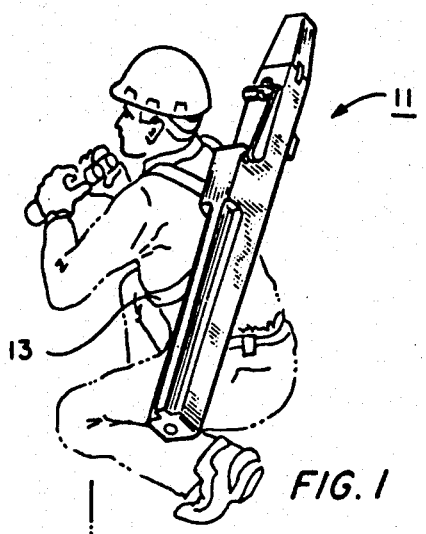
FIG. 1 is a view or an individual carrying the rapidly extendible and retractable mast of the invention, with the mast shown in the collapsed position illustrating the portable nature thereof.
Figure 2:
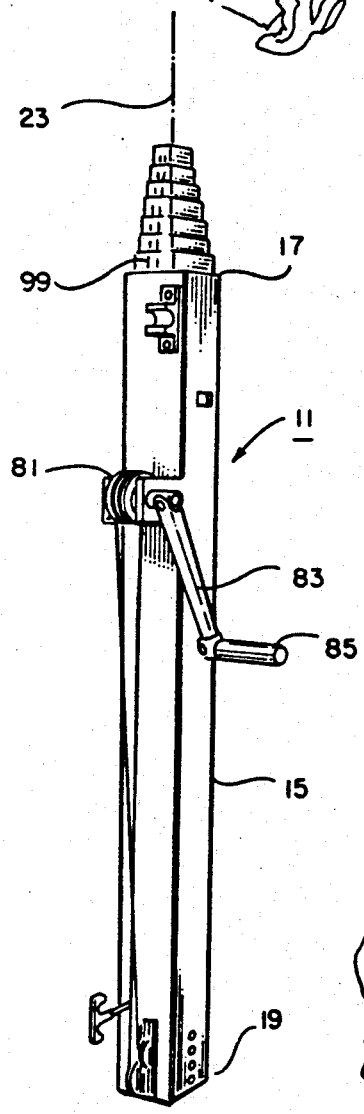
FIG. 2 is a perspective view of the antenna mast of FIG. 1 supported vertically on a surrounding terrain.
Figure 3:
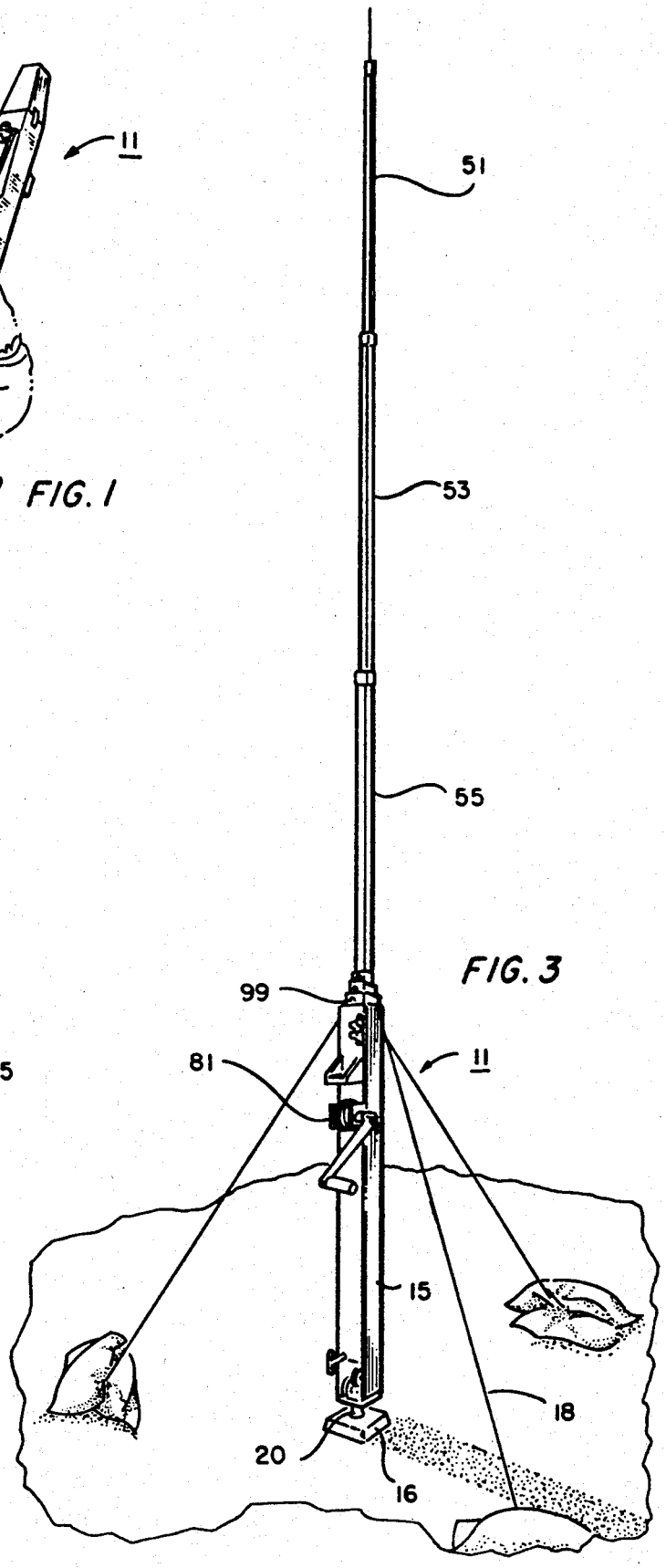
FIG. 3 is a perspective view of the antenna mast in the erected position.

FIG. 1 shows the rapidly extendible and retractable mast of the invention designated generally as 11. As shown in FIG. 1, the mast in the fully collapsed position is portable in nature and can be equipped with a carrying strap 13 for transport by a user. As best seen in FIG. 2, the mast 11 includes a tubular body 15 of polygonal cross-section, in this case generally square or rectangular. The tubular body 15 has an upper end 17, a lower end 19, and an open interior (21 in FIG. 4). The tubular body 15 also has a central, longitudinal axis (23 in FIG. 2). As shown in FIG. 3, the tubular body 15 can be mounted vertically from a suitable base 16 and can be stabilized by guy wires 18. In the embodiment shown, the tubular body 15 pivots about a swivel point 20 on the base 16 to facilitate orienting of the erected mast.

Figure 4:
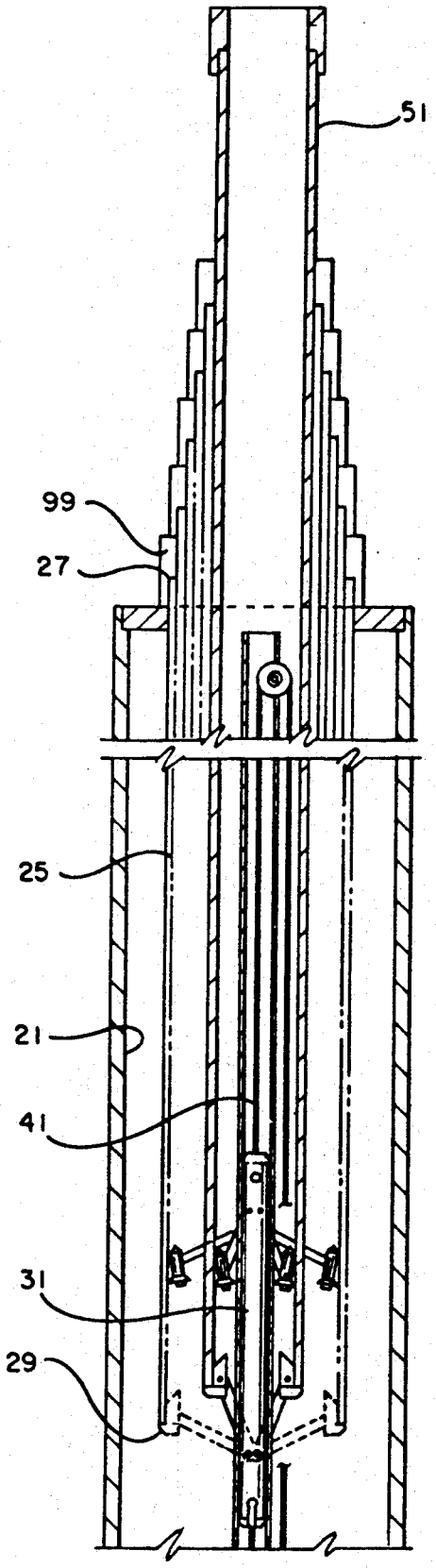
FIG. 4 is a partial, cross-sectional view of the antenna mast of the invention showing the telescopic sections thereof and the operation of the travelling carriage.
Figure 6:
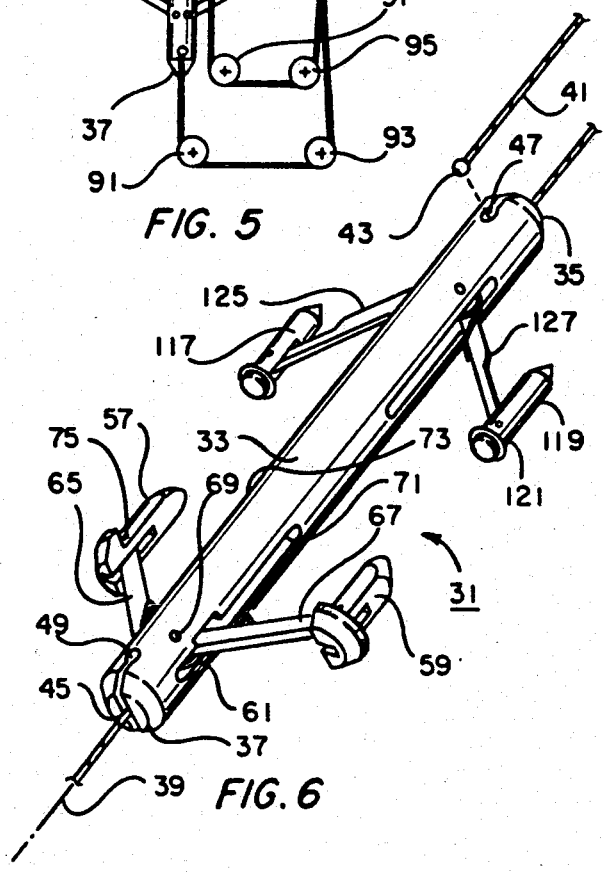
FIG. 6 is an isolated, perspective view of the travelling carriage.

As seen in FIGS. 3 and 4, a plurality of tubular, telescopic sections (e.g., section 51) of consecutively reduced transverse dimension are carried within the tubular body 15. Each of the telescopic sections 25 has a leading end 27 and a trailing end 29 (FIG. 4). As shown in FIG. 4, a travelling carriage 31 is centrally located within the open interior 21 of the tubular body 15 for travel along the central, longitudinal axis 23. As best seen in FIG. 6, the travelling carriage 31 is preferably formed as an elongate body 33 having an upper end 35, a lower end 37 and a longitudinal axis 39. A loop of cable 41 is attached to the upper and lower ends 35, 37 of the carriage 31, respectively. In the embodiment shown in FIG. 6, the cable ends 43, 45 terminate in beads which are received within mating slots 47, 49 provided on the carriage ends 35, 37 for retaining the cable and forming a continuous loop.

Engagement means are located on the travelling carriage 31 for sequentially engaging the trailing ends 29 of the telescopic sections 25, thereby extending the sections from the tubular body 15 between collapsed positions, shown in FIG. 2, substantially wholly engaged within the portable body, to any desired degree of elevation projecting from the upper end 17 of the body 15 (see FIG. 3). In the erected position shown in FIG. 3, sections 51, 53 and 55 are shown projecting from the body 15 and locked at the desired degree of elevation.

Figure 5:
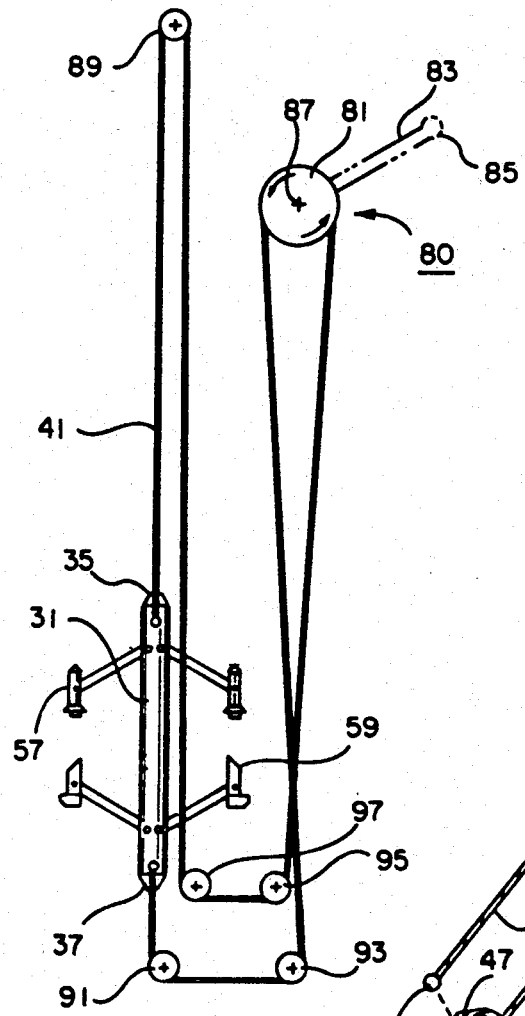
FIG. 5 is an isolated view of the travelling carriage, drive means and continuous loop of cable used for moving the travelling carriage.

Preferably, the engagement means comprises a plurality of spring biased engagement dogs carried on the travelling carriage. As shown in FIGS. 5 and 6, the dogs 57, 59 are normally spring biased outwardly in a radial direction with respect to the longitudinal axis 39 of the body 33, as by coil springs 61. It will be appreciated from FIG. 6 that each dog 57, 59 includes an associated leg which is pivotally mounted at a pivot point 69, whereby the legs are pivotable radially within associated slots 71, 73 provided in the carriage body 33. Each dog 57, 59 is also mounted for pivotal movement at its respective leg outer extent at a pivot point 75.

As shown in FIG. 10, each dog 57 includes an upper, sloped exterior 77 which converges to a tubular portion, the tubular portion including a stepped exterior surface 79 which forms a support collar for supporting and erecting the telescopic sections 25 between the collapsed position shown in FIG. 2, substantially wholly engaged within the portable body 15, and the erected positions as shown in FIG. 3.

Drive means are provided for moving the travelling carriage 31 along the central, longitudinal axis 23 of the portable body 15 between the extended, erected position and the retracted collapsed position. As shown in FIG. 5, the drive means can comprise a winch 80 including capstand 81, crank 83 and handle 85. The continuous length of cable 41 passes over the cylindrical outer surface of the capstand 81 in several turns, whereby rotating the crank 83 about the central axis 87 of the capstand causes the travelling carriage 31 to be raised and lowered along the central longitudinal axis 23 of the tubular body 15. The loop of cable 41 passes from the ends 35, 37 of the carriage 31 over intermediate sheaves 89, 91, 93, 95, 97 (FIG. 5) which are mounted within the tubular body 15.

As shown in FIGS. 7-9, a plurality of locking cams 99 are carried on the tubular body 15. Each locking cam is associated with a selected one of the telescopic sections 25 which are carried within the tubular body for locking the selected telescopic section at any desired degree of elevation projecting from the upper end 17 of the body 15. The locking cams are initially stacked one upon the other (FIGS. 2 and 9) on the upper end (17 in FIG. 2) of the tubular body 15.

As shown in FIGS. 7 and 8, each locking cam has a frictional engagement means, such as roller 101, mounted within a recess in the interior thereof. The body 103 of each locking cam includes a central opening 105 for receiving the telescopic section 25 and is provided with a radial opening 107 for exposing the roller 101 for contact and frictional engagement with the telescopic section 25. A thumb operated detent 109 pivots the roller 101 between the frictional engagement position and a release position.

FIG. 9 illustrates the movement of a telescopic section 111 toward the erected position. Cam 103 is engaged by the section 111 and is pivoted upward about horizontal axis 104, allowing the section to move in an upward vertical direction. Cam 103 will not pivot downwardly past the horizontal position shown in solid lines in FIG. 9, thereby prohibiting downward vertical movement until the thumb detent 109 is actuated. Note that while the inner section 111 is being raised, that the next consecutive outer sections 113, 115 are not affected. This allows a section, such as section 111, to be erected to any desired degree of elevation and held in position by the respective cam lock as subsequent sections of the device are erected.

Retraction means are also located on the travelling carriage 31 for assisting in retracting the telescopic sections 25 from the elevated, erecting positions to the collapsed positions substantially wholly engaged within the body 15. As shown in FIG. 6, the retraction means preferably comprises a second, distinct set of spring biased, retraction dogs 117, 119 which are carried on the travelling carriage 33 and arranged oppositely to the engagement dogs 57, 59. Each retraction dog 117, 119 includes an associated leg 125, 127. Each leg is spring biased within an associated slot, similar to the engagement dogs, and each retraction dog is pivotally arranged upon its associated leg in the fashion of the engagement dogs. Each retraction dog 117, 119 is provided with an external projection 121 which forms an external collar with respect to the body of the dog. As best seen in FIG. 10, each telescopic section 25 is provided with a mating recess 123, whereby actuation of the drive means to move the travelling carriage 31 between the extended and retracted positions causes the external projections 121 to be received within the mating recesses 123. In this way, the travelling carriage 31 provides a power assist to facilitate the retraction of the telescopic section 25 within the tubular body 15.

Figure 20:
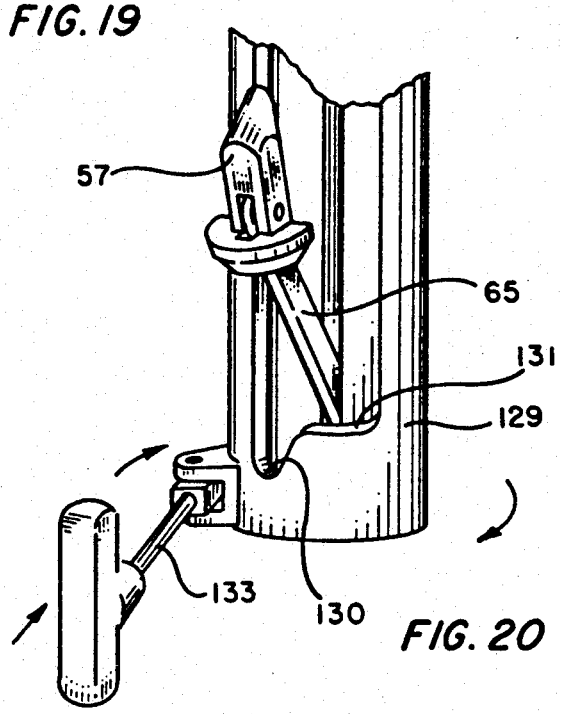
FIG. 20 is a partial, perspective view of an engagement dog of the travelling carriage contacting the lower cam surface of the selector sleeve.

Selector means are provided as a part of the tubular body 15 for alternately actuating the engagement dogs and retraction dogs in order to erect and retract the telescopic sections. The selector means can comprise a cam sleeve 129 (FIGS. 15 and 20) having a lower cam surface 130 formed thereon for contacting the legs 65 of the engagement dogs. The cam sleeve is rotatably shiftable by means of a hand lever 133 between a lifting position (FIG. 15) and a lowering position (FIG. 16).

Figure 15:
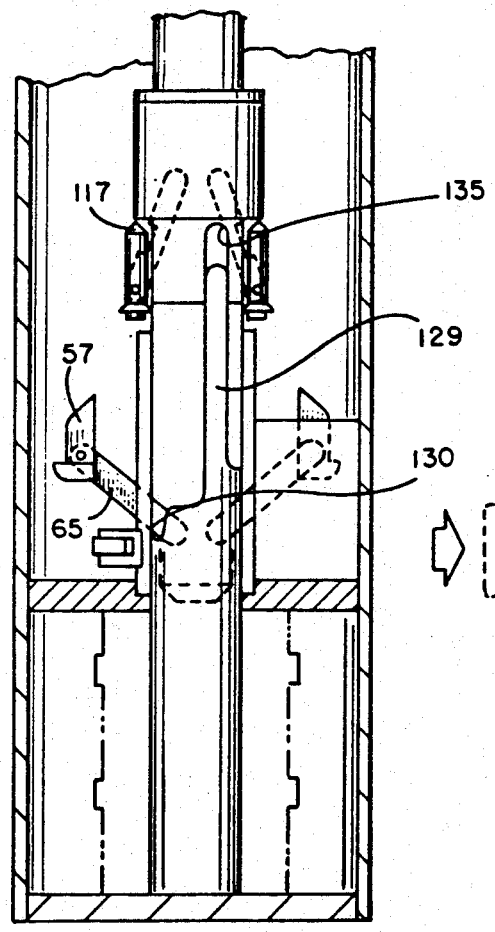
FIG. 15 is a schematic view of the device prior to the beginning of the retraction operation of the mast and showing the upper and lower cam surfaces of the selector sleeve.
Figure 16:
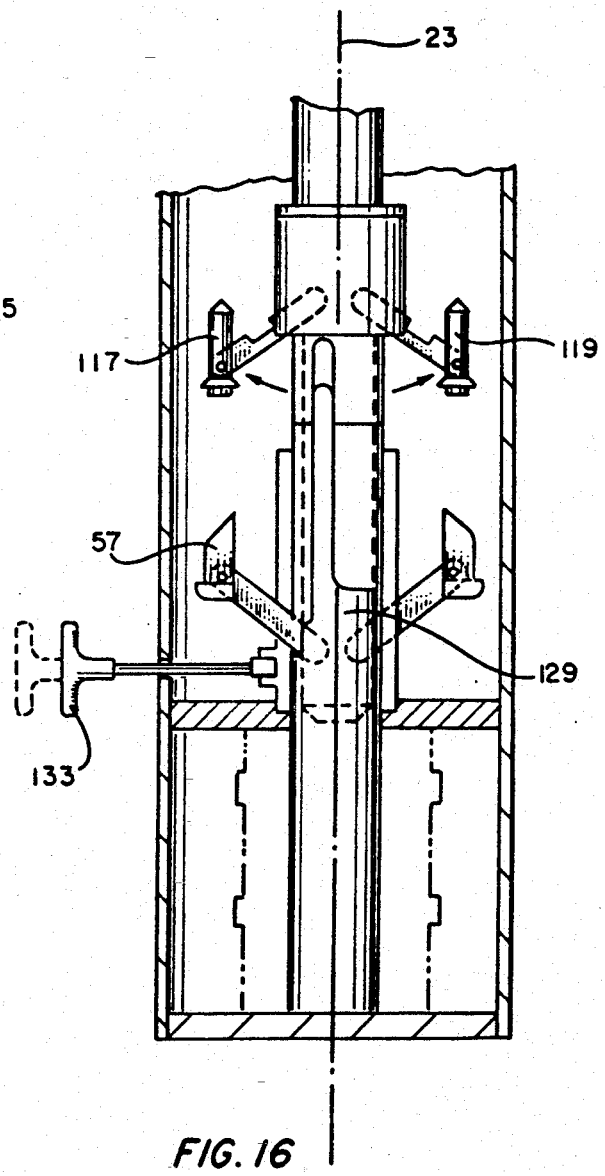
FIG. 16 shows the beginning of the retraction operation in which the hand lever is used to shift the selector sleeve, thereby releasing the retraction dogs.
Figure 17:
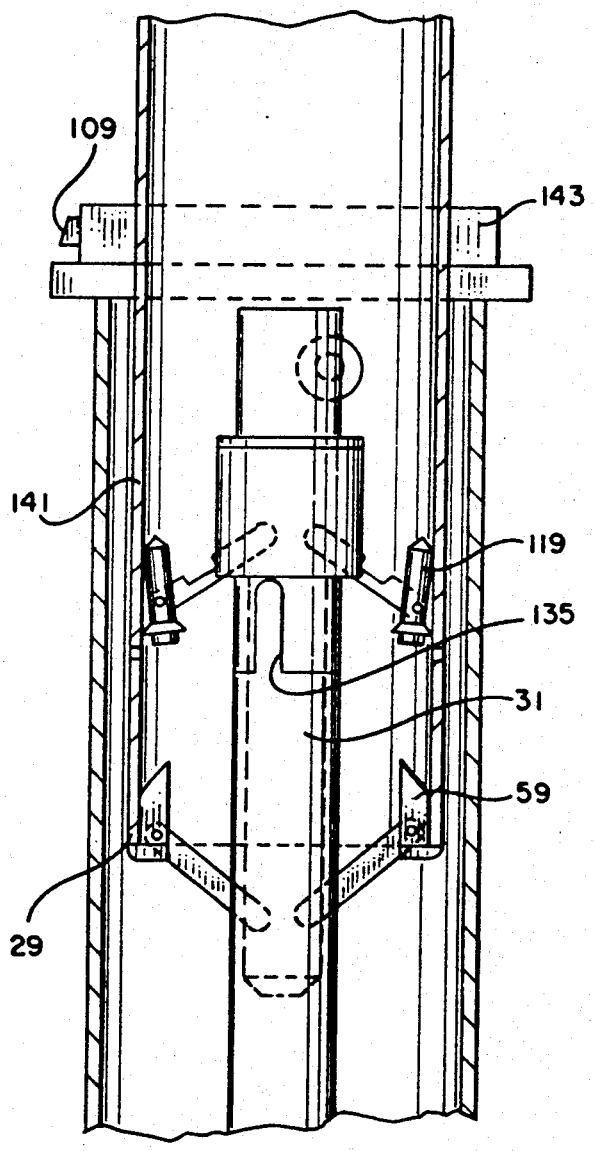
FIG. 17 further illustrates the retraction operation as the retraction dogs move toward the mating recesses provided within the interior of the telescopic section being retracted.

The selector means further includes an upper cam surface 135 for initially restraining the retraction dogs 117, 119, wherein movement of the cam sleeve from the lifting position to the lowering position causes the retraction dogs to move from a first, radially inward biased position (FIG. 15) to a second, radially outward biased position (FIG. 16).

Figure 11:
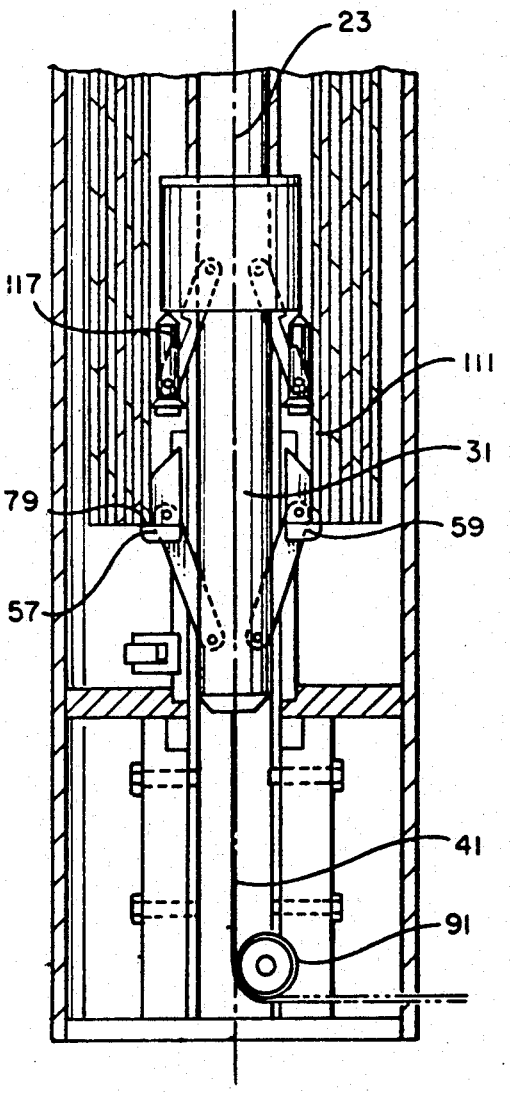
FIG. 11 is a partial, schematic view of the travelling carriage and telescopic sections located within the portable, tubular body showing the innermost telescopic section engaged by the engagement dogs of the travelling carriage.

The operation of the device will now be described in greater detail. Turning first to FIG. 11, the travelling carriage 31 is shown in the retracted position with the continuous cable 41 running along the central longitudinal axis 23 over sheave 91 to the drive means. The engagement dogs 57, 59 are supporting the lower end of the innermost telescopic section 111 upon the stepped exterior surfaces 79 thereof. The retraction dogs 117 are in the inwardly biased position.

Figure 12:
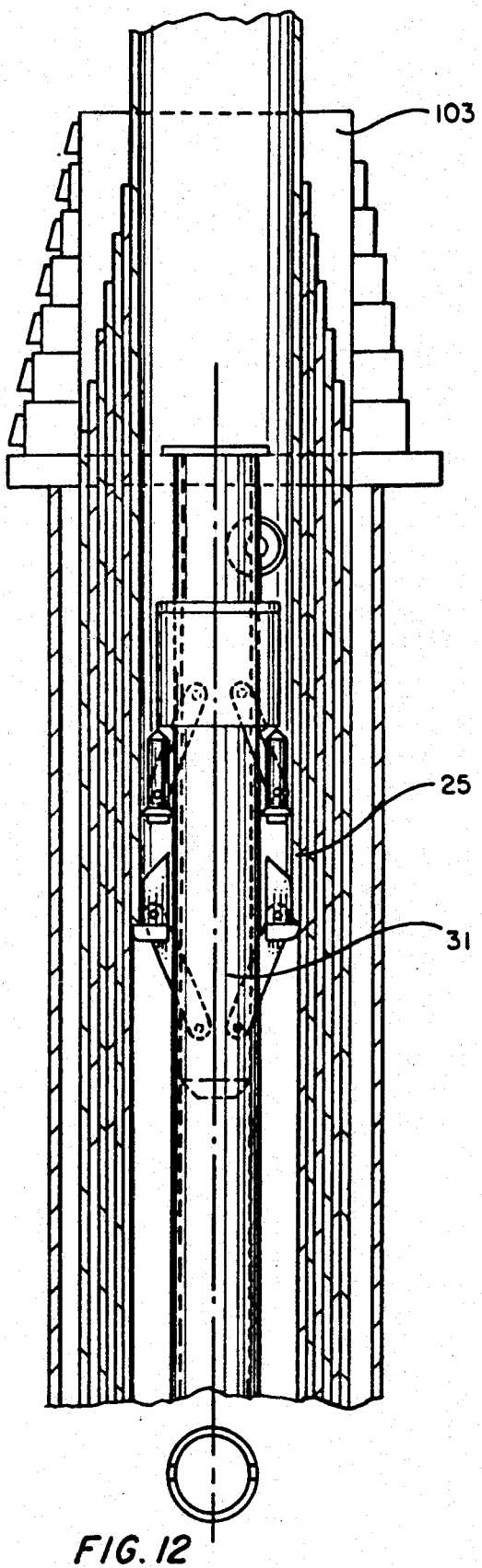
FIG. 12 is a view similar to FIG. 11 showing the beginning elevation of the innermost telescopic section by the travelling carriage.

FIG. 12 shows the actuation of the drive means by turning crank 83 in a clockwise direction. This action causes the travelling carriage 31 to move vertically upward along the central longitudinal axis 23, thereby raising the inner most telescopic section 25 to a desired degree of elevation. The first cam lock 103 is in the position shown in dotted lines in FIG. 9, allowing upward travel of the telescopic section 111. At the desired degree of elevation, the cam roller 101 frictionally engages the external sidewall of the telescopic section, thereby prohibiting downward vertical movement thereof.

Figure 13:
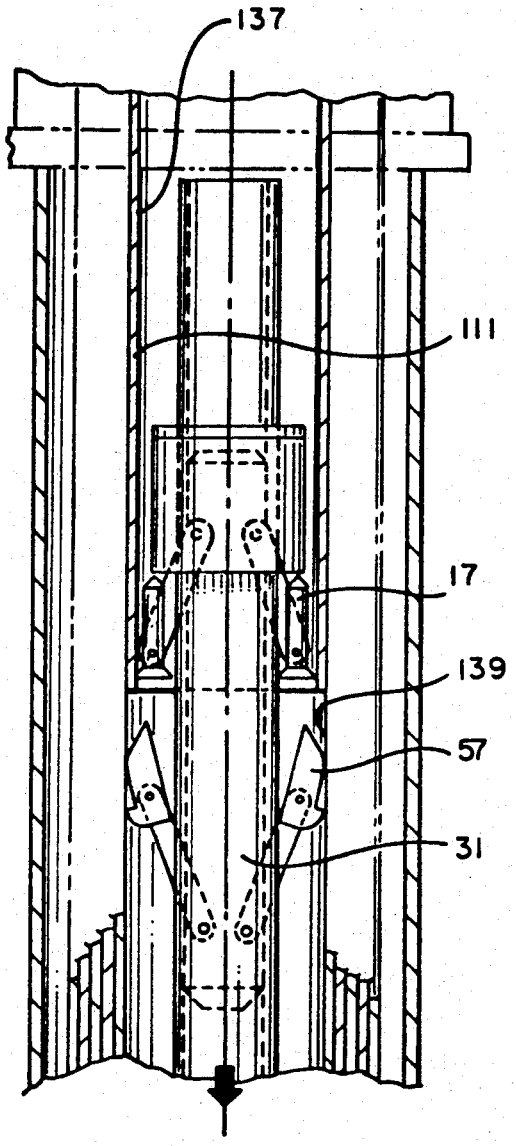
FIG. 13 is a further, schematic view of the operation of the device showing the travelling carriage moving downward after the inner most telescopic section has been locked into position by the locking cam.
Figure 14:
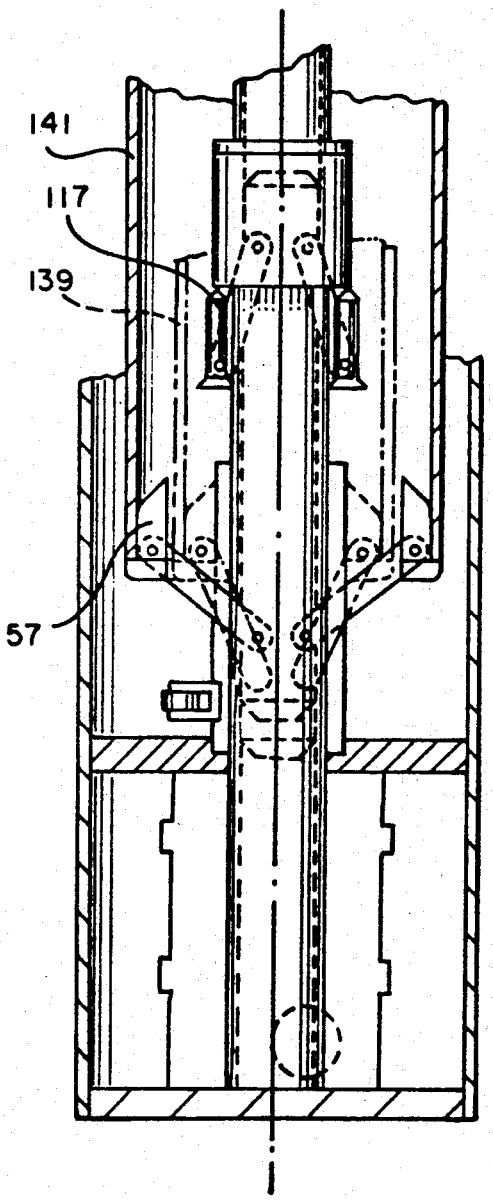
FIG. 14 is a view similar to FIG. 13 showing the engagement dogs of the travelling carriage engaging the next telescopic section in dotted lines and engaging the outermost telescopic section in solid lines.

Once the innermost telescopic section has been raised to the desired degree of elevation, the movement of the crank 83 is reversed, causing the continuous cable loop 41 to move in the opposite direction. This causes the travelling carriage 31 to move from the extended toward the retracted position, as shown in FIG. 13. FIG. 13 shows the innermost telescopic section 111 supported in an extended position by the cam lock. The retraction dogs are biased radially inward and slide along the interior surface 137 of the section 111. As the engagement dogs 5 leave the relatively smaller internal diameter of the section 111 and enter the relatively larger internal diameter of the next consecutive section 139, they are allowed to spring slightly radially outward. FIG. 14 shows the engagement dogs 57 picking up the next consecutive telescopic section 139 in dotted lines and picking up the last or outer most telescopic section 141 in solid lines. The retraction dogs continue to be biased inwardly by the cam sleeve to the inward radial position. As each consecutive telescopic section is extended to the erected position, it is locked in the selected vertical elevation by means its respective locking cam (e.g. cam 99 in FIG. 3).

Figure 18:
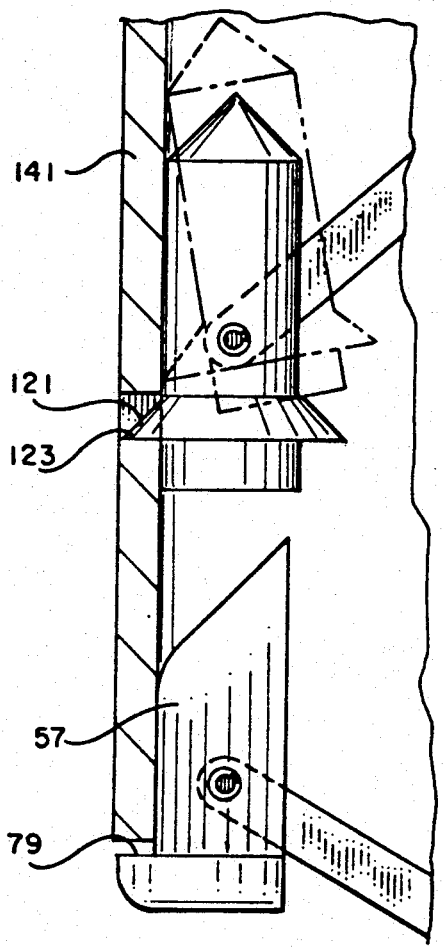
FIG. 18 is an isolated view of the engagement and retraction dogs showing the power assist used to retract the telescopic sections.

FIG. 15 shows the position of the device just prior to beginning the retraction operation with the leg 65 of the engagement dog 57 mating within the opening provided by the lower cam surface 130. The upper cam surface of the cam sleeve holds the retraction dogs in the inwardly biased position. To begin the retraction operation, the selector lever 133 (FIG. 16) is moved radially inward, causing the cam sleeve 129 to move in a clockwise direction about the central longitudinal axis 23, thereby shifting the upper cam surface and freeing the retraction dogs 117, 119. The crank 83 is then turned, causing the travelling carriage 31 to move upwardly within the tubular body 15 until the engagement dogs 59 contact the trailing end 29 (17) of the outer most telescopic section 141. The associated cam lock 143 is then released by means of detent 109, freeing the telescopic section. By turning the winch and lowering the travelling carriage 31, the section 141 can be lowered from the erected to the collapsed position. However, if dirt or other foreign obstruction causes the section to temporarily hang, the external projection 121 (FIG. 18) of the retraction dog will fall into the mating recess 123 provided in the telescopic section 141, thereby providing a power assist for retracting the section into the tubular body 15. Once the section is freed, it will normally fall down and rest upon the stepped exterior surface 79 of the engagement dog 57.

Figure 19:
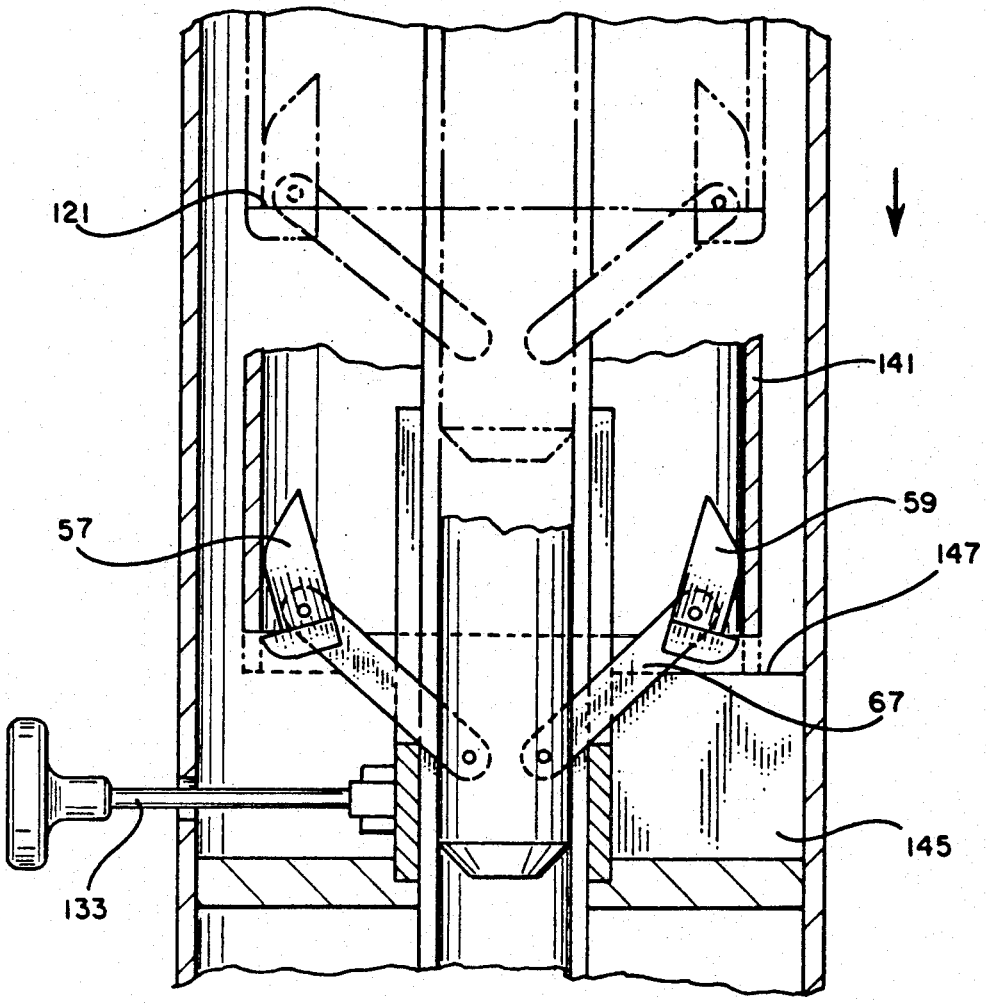
FIG. 19 shows the outermost telescopic section being lowered within the tubular body to the fully collapsed position.

FIG. 19 shows the continued retraction of the section 141. As the carriage moves from the position shown in dotted lines to the position shown in solid lines, the leg 67 of the engagement dogs 59 contacts the upper surface 131 of a cam sleeve 129, thereby pivoting the leg 67 radially inward to the position shown in solid lines in FIG. 19. This action releases the telescopic section 141, allowing it to fall a short distance to the upper surface 147 of the standoff block 145. The direction of operation of the crank 83 would then be reversed to cause the carriage to travel back up the interior of the section 141 to engage the trailing end of the next smaller consecutive telescopic section. The retraction operation would then be repeated until each successively smaller cross-sectioned telescopic section is returned to the collapsed position within the tubular body 15.

An invention has been provided with several advantages. The mast of the invention can be rapidly extended and retracted within a minimum of physical effort. The device is relatively lightweight and portable and can be handled by a single user. The continuous loop cable system and drive mechanism is extremely simple and dependable in operation. There are relatively few moving parts, thereby reducing the cost of manufacture and simplifying repair. The locking cams allow each section to be locked at a selected, desired elevation so that it is unnecessary to extend the first telescopic section to its full length before extending the next consecutive section. The size and compact nature of the collapsed mast facilitates its transportation.

While the invention has been shown in only one of its forms, it is not thus limited but is susceptible to various changes and modifications without departing from the spirit thereof

What is claimed is:

1. A rapidly extendible and retractable mast, comprising:

a tubular body having an upper end, a lower end and an open interior with a central, longitudinal axis;

a plurality of tubular, telescopic sections of consecutively reduced transverse dimension carried within the tubular body, each of the telescopic sections having a leading end and a trailing end;

a traveling carriage centrally located within the tubular body for travel along the central, longitudinal axis of the tubular body;

engagement means located on the traveling carriage for sequentially engaging the trailing ends of the telescopic sections for erecting the sections from the tubular body between collapsed positions substantially wholly engaged within the tubular body to any desired degree of elevation projecting from the upper end of the tubular body;

mechanical drive means for moving the traveling carriage along the central, longitudinal axis of the tubular body between an extended position and a retracted position;

wherein the drive means is operatively connected to the traveling carriage by a continuous length of cable; and a plurality of locking cams carried on the upper end of each of selected ones of said plurality of tubular, telescopic section each locking cam being associated with each of said selected ones of the tubular, telescopic sections of consecutively reduced transverse dimension carried within the tubular body for locking the selected telescopic section at any desired degree of elevation projecting from the upper end of the tubular body.

2. The mast of claim 1, wherein the traveling carriage is an elongate body having an upper end, a lower end, and a longitudinal axis, the continuous length of cable being attached to the upper and lower ends of the carriage, respectively.

3. The mast of claim 2, wherein the engagement means comprises a plurality of spring biased engagement dogs carried on the traveling carriage, the dogs being normally biased outwardly in a radial direction with respect to the longitudinal axis of the elongate body.

4. The mast of claim 1, wherein the locking cams are initially stacked one upon the other on the upper end of the tubular body, each locking cam having frictional engagement means thereon for allowing upward, vertical travel of a selected telescopic section but for restricting downward, vertical travel thereof.

5. A rapidly extendible and retractable antenna mast, comprising:

a portable, tubular body having an upper end, a lower end and an open interior with a central, longitudinal axis;

a plurality of tubular, telescopic sections of consecutively reduced transverse dimension carried within the portable, tubular body, each of the telescopic sections having a leading end and a trailing end;

a traveling carriage centrally located within the portable, tubular body for travel along the central, longitudinal axis of the portable, tubular body, wherein the traveling carriage is an elongate body having an upper end, a lower end, and a longitudinal axis;

engagement means located on the traveling carriage for sequentially engaging the trailing ends of the telescopic sections for erecting the sections from the tubular body between collapsed positions substantially wholly engaged within the portable body to any desired degree of elevation projecting from the upper end of the portable body, wherein the engagement means comprises a plurality of spring biased engagement dogs carried on the traveling carriage, the dogs being normally biased outwardly in a radial direction with respect to the longitudinal axis of the elongate body;

mechanical drive means for moving the traveling carriage along the central, longitudinal axis of the portable body between an extended position and a retracted position;

wherein the drive means is operatively connected to the traveling carriage by a continuous length of cable;

retraction means located on the traveling carriage for assisting in retracting the telescopic sections from the elevated, projecting position to the collapsed position substantially wholly engaged within the portable body; and wherein the retraction means comprises a second, distinct set of spring biased, retraction dogs carried on the traveling carriage and arranged oppositely to the engagement dogs.

6. The antenna mast of claim 5, wherein each engagement dog has a stepped exterior which forms a support collar for supporting and erecting the telescopic sections between the collapsed position substantially wholly engaged within the portable body and the projecting position.

7. The antenna mast of claim 6, wherein the retraction dogs are provided with external projections and wherein the telescoping sections are provided with mating recesses, whereby actuation of the drive means to move the traveling carriage between the extended and retracted positions causes the external projections to be received within the mating recesses, whereby the traveling carriage provides a power assist to facilitate the retraction of the telescopic sections within the portable, tubular body.

8. A rapidly extendible and retractable antenna mast, comprising:

a portable, tubular body having an upper end, a lower end and an open interior with a central, longitudinal axis;

a plurality of tubular, telescopic sections of consecutively reduced transverse dimension carried within the portable, tubular body, each of the telescopic sections having a leading end and a trailing end;

a traveling carriage centrally located within the portable, tubular body for travel along the central, longitudinal axis of the portable, tubular body, the traveling carriage comprising an elongate body having an upper end, a lower end, and a longitudinal axis;

engagement means located on the traveling carriage for sequentially engaging the trailing ends of the telescopic sections for erecting the sections from the tubular body between collapsed positions substantially wholly engaged within the portable body to any desired degree of elevation projecting from the upper end of the portable body, the engagement means comprising a plurality of spring biased engagement dogs carried on the traveling carriage, the dogs being normally biased outwardly in a radial direction with respect to the longitudinal axis of the elongate body;

mechanical drive means for moving the traveling carriage along the central, longitudinal axis of the portable body between an extended position and a retracted position;

wherein the drive means is operatively connected to the traveling carriage by a continuous length of cable;

retraction means located on the traveling carriage for assisting in retracting the telescopic sections from the elevated, projecting position to the collapsed position substantially wholly engaged within the portable body, the retraction means comprises a second, distinct set of spring biased, retraction dogs carried on the traveling carriage and arranged oppositely to the engagement dogs; and selector means provided as a part of the portable body for alternately actuating the engagement dogs and retraction dogs between the engagement and retraction positions for erecting and retracting the telescopic sections.

9. The antenna mast of claim 8, wherein the selector means comprises a selector sleeve having a cam surface formed thereon for contacting the engagement dogs, the cam sleeve being shiftable between a lifting position in which the engagement dogs are spring biased radially outward and a lowering position.

10. The antenna mast of claim 9, wherein the selector sleeve further includes an upper cam surface for contacting the retraction dogs, and wherein movement of the cam sleeve from the lifting position to the lowering position causes the retraction dogs to move from a first, radially inward biased position to a second, radially outwardly biased position.

11. The antenna mast of claim 10, further comprising an external lever for shifting the selector sleeve between the lifting and lowering positions.

* * * * *